US008430702B2

(12) United States Patent
Davidson et al.

(10) Patent No.: US 8,430,702 B2
(45) Date of Patent: Apr. 30, 2013

(54) STEERING ASSEMBLY FOR A MARINE VESSEL WITH VERTICALLY OFFSET PROPULSION

(76) Inventors: Noam Davidson, Vancouver (CA); Richard Redfern, Delta (CA); Neal D. Wood, Coquitlam (CA)

( * ) Notice: Subject to any disclaimer, the term of this patent is extended or adjusted under 35 U.S.C. 154(b) by 0 days.

(21) Appl. No.: 13/071,874

(22) Filed: Mar. 25, 2011

(65) Prior Publication Data

US 2012/0244761 A1 Sep. 27, 2012

(51) Int. Cl.

| | |
|---|---|
| ***B63H 5/125*** | (2006.01) |
| ***B63H 20/08*** | (2006.01) |
| ***B63H 20/12*** | (2006.01) |
| ***B63H 25/22*** | (2006.01) |
| ***B63H 25/42*** | (2006.01) |

(52) U.S. Cl.
USPC ..... 440/61 R; 440/61 S; 440/63

(58) Field of Classification Search ..... 114/144 R; 440/53, 61 R–61 C, 62, 63
See application file for complete search history.

(56) References Cited

U.S. PATENT DOCUMENTS

| | | | | |
|---|---|---|---|---|
| 4,836,812 | A * | 6/1989 | Griffiths | 440/61 R |
| 5,002,510 | A | 3/1991 | Rump | |
| 5,092,801 | A * | 3/1992 | McBeth | 440/61 R |
| 5,152,240 | A | 10/1992 | Fontanille | |
| 5,601,463 | A * | 2/1997 | Kobelt | 440/61 R |
| 5,658,177 | A | 8/1997 | Wagner | |
| 5,934,956 | A | 8/1999 | Michel et al. | |
| 5,997,370 | A * | 12/1999 | Fetchko et al. | 440/61 R |
| 6,044,674 | A | 4/2000 | Rushing et al. | |
| 6,261,139 | B1 * | 7/2001 | Stiteler | 440/61 R |
| 6,322,408 | B1 | 11/2001 | Latham | |
| 6,406,340 | B1 * | 6/2002 | Fetchko et al. | 440/61 R |
| 6,485,214 | B2 | 11/2002 | Schill | |
| 6,913,497 | B1 * | 7/2005 | Ahlswede et al. | 440/63 |
| 7,128,626 | B2 * | 10/2006 | Dudra et al. | 440/63 |
| 7,147,525 | B2 * | 12/2006 | Sasayama et al. | 440/61 R |
| 2008/0026655 | A1 * | 1/2008 | Gai et al. | 440/61 S |

* cited by examiner

*Primary Examiner* — Ajay Vasudeva
(74) *Attorney, Agent, or Firm* — Cameron IP

(57) ABSTRACT

In some embodiments, a hydraulic steering actuator may be provided. The actuator may include: a cylinder and piston rod reciprocatingly mounted within the cylinder and extending through the cylinder for movement along a piston rod axis; a pair of spaced-apart cylinder arms extending radially outward of the cylinder and a pivot plate extending between the cylinder arms; a pair of support arms which are pivotable about a tilt axis and are connected to opposite ends of the piston rod to allow arcuate movement of the piston rod about the tilt axis while maintaining the piston rod axis parallel to the tilt rod axis; and a tie bar mount disposed on the cylinder and having an aperture extending therethrough for the receiving a connecting member which connects a tie bar to the tie bar mount, wherein the aperture extends axially in a direction substantially perpendicular to the piston rod axis.

15 Claims, 12 Drawing Sheets

STEERING ASSEMBLY FOR A MARINE VESSEL WITH VERTICALLY OFFSET PROPULSION

BACKGROUND OF THE INVENTION

1. Field of the Invention

The present invention relates to a steering assembly for a marine vessel and, in particular, to a steering assembly for a marine vessel with vertically offset propulsion units.

2. Description of the Related Art

Marine vessels are often provided with more than one propulsion unit. Typically tie bars are used to mechanically couple the propulsion units. U.S. Pat. No. 6,406,340 to Fetchko et al. and U.S. Pat. No. 7,128,626 to Dudra et al., the full disclosures of which are incorporated herein by reference in their entirety, both disclose using a tie bar to couple propulsion units on a marine vessel. This allows the propulsion units to be steered simultaneously.

It is also known to provide steering assemblies which accommodate vertically offset propulsion units. U.S. Pat. No. 6,699,082 to Zeigler et al., the full disclosure of which is also incorporated herein by reference in its entirety, discloses a steering assembly using spacers to accommodate vertical offsets between propulsion units. However, in the steering assembly disclosed by Zieger et al., the tie bars are connected to the propulsion units on a horizontal plane.

There is accordingly a need for an improved steering assembly for marine vessels with vertically offset propulsion units.

SUMMARY OF THE INVENTION

Some embodiments may provide an improved steering assembly for a marine vessel which has vertically offset propulsion units.

Some embodiments may provide a steering assembly having improved steering actuators provided with upwardly or downwardly extending tie bar mounts to reduce the slope of tie bars connecting adjacent, vertically offset propulsion.

There is accordingly, in some embodiments, a hydraulic steering actuator provided. The actuator may include: a cylinder and piston rod reciprocatingly mounted within the cylinder and extending through the cylinder for movement along a piston rod axis; a pair of spaced-apart cylinder arms extending radially outward of the cylinder and a pivot plate extending between the cylinder arms; a pair of support arms which are pivotable about a tilt axis and are connected to opposite ends of the piston rod to allow arcuate movement of the piston rod about the tilt axis while maintaining the piston rod axis parallel to the tilt rod axis; and a tie bar mount disposed on the cylinder and having an aperture extending therethrough for the receiving a connecting member which connects a tie bar to the tie bar mount, wherein the aperture extends axially in a direction substantially perpendicular to the piston rod axis.

In some embodiments, a hydraulic steering assembly for applying a force to tillers of at least two marine propulsion units my be provided. The the hydraulic steering assembly may include: a first hydraulic steering actuator operatively coupled to a tiller of a first propulsion unit, the first hydraulic steering actuator including a cylinder and piston rod reciprocatingly mounted within the cylinder and extending through the cylinder for movement along a piston rod axis; a pair of spaced-apart cylinder arms extending radially outward of the cylinder and pivot plate extending between the cylinder arms; a pair of support arms which are pivotable about a tilt axis and are connected opposite ends of the piston rod to allow arcuate movement of the piston rod about the tilt axis while maintaining the piston rod axis parallel to the tilt rod axis; and a tie bar mount disposed on the cylinder and having an aperture extending in an axial direction substantially perpendicular to the piston rod axis thereof; a second hydraulic steering actuator operatively coupled to a tiller of a second propulsion unit, the second hydraulic steering actuator including a cylinder and piston rod reciprocatingly mounted within the cylinder and extending through the cylinder for movement along a piston rod axis; a pair of spaced-apart cylinder arms extending radially outward of the cylinder and a pivot plate extending between the cylinder arms; a pair of support arms which are pivotable about a tilt axis and are connected to opposite ends of the piston rod to allow arcuate movement of the piston rod about the tilt axis while maintaining the piston rod axis parallel to the tilt rod axis; and a tie bar mount disposed on the cylinder and having an aperture extending axially in a direction substantially perpendicular to the piston rod axis thereof; and a tie bar coupling the tie bar mount of the first hydraulic actuator to the tie bar mount of the second hydraulic actuator, wherein a first connecting member which connects the tie bar to the tie bar mount of the first hydraulic actuator extends in a direction substantially perpendicular to the tilt axis of the first hydraulic actuator and a second connecting member which connects the tie bar to the tie bar mount of the second hydraulic actuator extending in a direction substantially perpendicular to the tilt axis of the second hydraulic actuator.

The upwardly and downwardly extending tie bar mounts reduce the slope of tie bars connecting adjacent, vertically offset propulsion units. The asymmetrical shape of the tie bar mounts provide an original equipment manufacturer (OEM) with the advantage of only having to use a single component regardless of whether the tie bar mount will extend in an upwardly or downwardly direction relative to the piston rod axis of steering actuator.

BRIEF DESCRIPTION OF DRAWINGS

The invention will be more readily understood from the following description of the embodiments thereof given, by way of example only, with reference to the accompanying drawings, in which.

DESCRIPTIONS OF THE PREFERRED EMBODIMENTS

Figure 1:
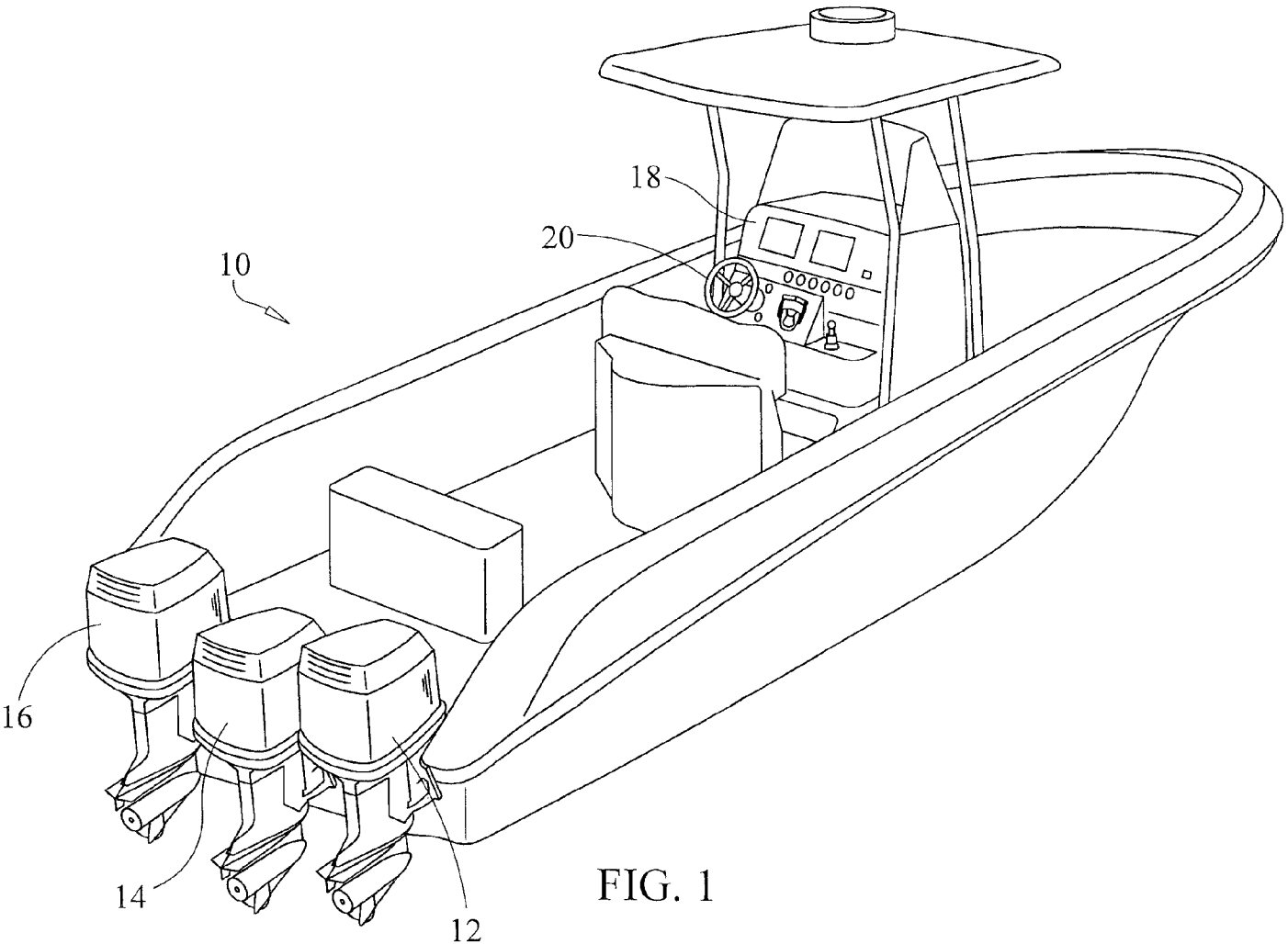
FIG. 1 is a perspective view of a marine vessel provided with a plurality of propulsion units and an improved steering assembly.

Referring to the drawings and first to FIG. 1, this shows a marine vessel 10 which is provided with a plurality of propulsion units in the form of three outboard engines 12, 14 and 16. However, in the other examples, the marine vessel 10 may be provided with any suitable number of inboard and/or outboard engines. It is common to see two engines and up to five engines in pleasure marine vessels. The marine vessel 10 is also provided with helm station 18 that includes a helm 20 for steering the marine vessel 10. The helm 20 is operatively connected to a hydraulic pump (not shown) and is part of a hydraulic steering system which is used to steer the marine vessel 10.

Figure 2:
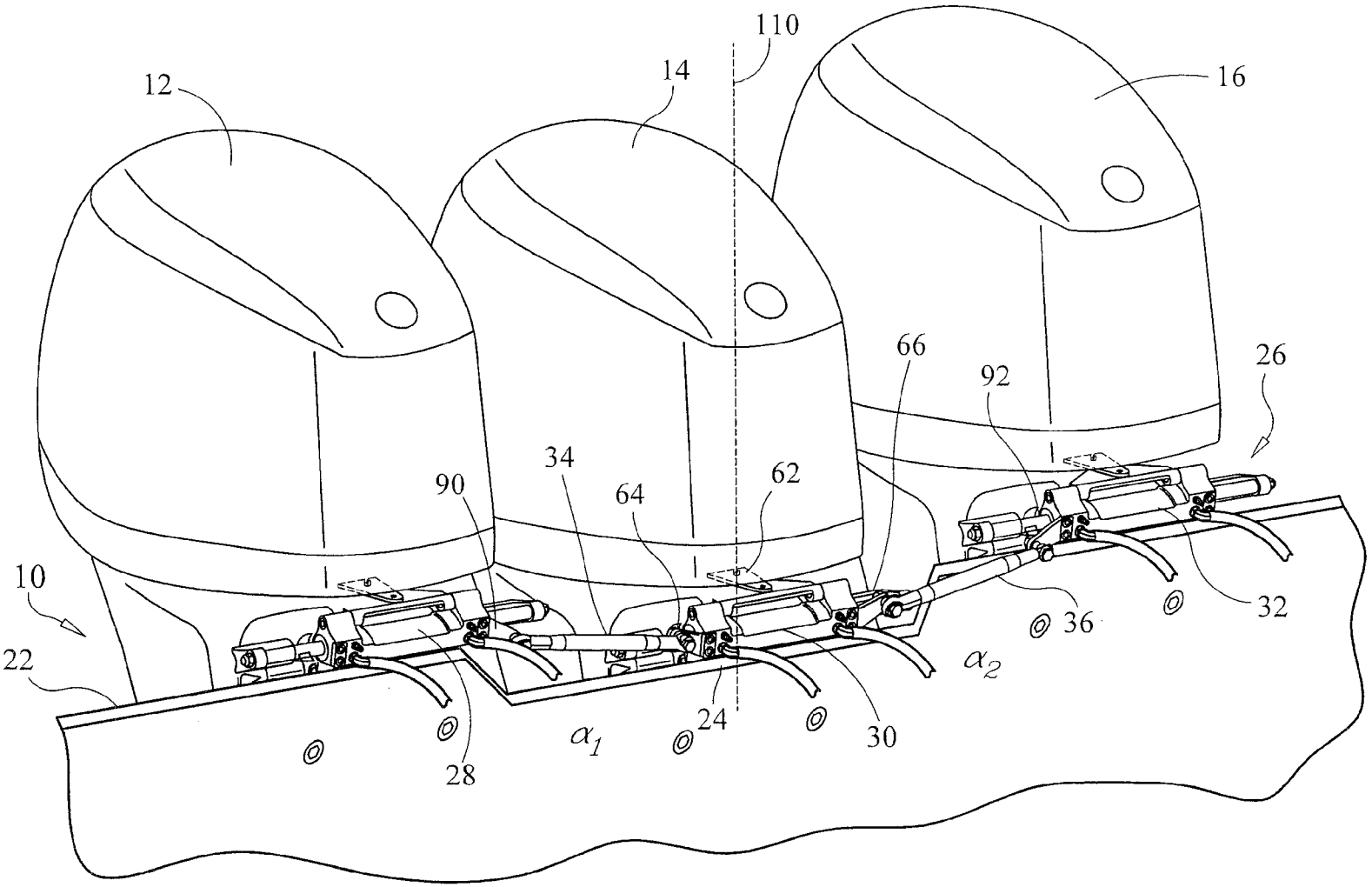
FIG. 2 is a perspective view of the improved steering system and propulsion units.

As best shown in FIG. 2, the engines 12, 14 and 16 are mounted on a transom 22 of the marine vessel 10, which is shown in fragment. The center engine 14 is mounted inside a centrally disposed, recessed portion 24 of the transom 22. The starboard and port side engines 12 and 16 are mounted on opposite sides of the transom 22 outside the recessed portion 24. The center engine 14 is accordingly vertically offset with respect to the starboard and port side engines 12 and 16. A steering assembly indicated generally by reference numeral 26 mechanically couples the engines. This allows the engines to be steered simultaneously. The steering assembly 26, better shown in FIG. 3, includes a plurality of steering actuators 28, 30 and 32 together with tie bars 34 and 36 which connect adjacent steering actuators. The steering actuators have a substantially similar structure and function in a substantially similar manner. It should be understood that not all transoms 22 are at different heights as shown in FIG. 2. Thus, vessels where the transom 22 is at the same height along its length may also be used in accordance with other embodiments. After reading the disclosure contained herein, one of ordinary skill in the art will understand what modifications may be necessary to practice the features contained herein with such a vessel.

Figure 3:
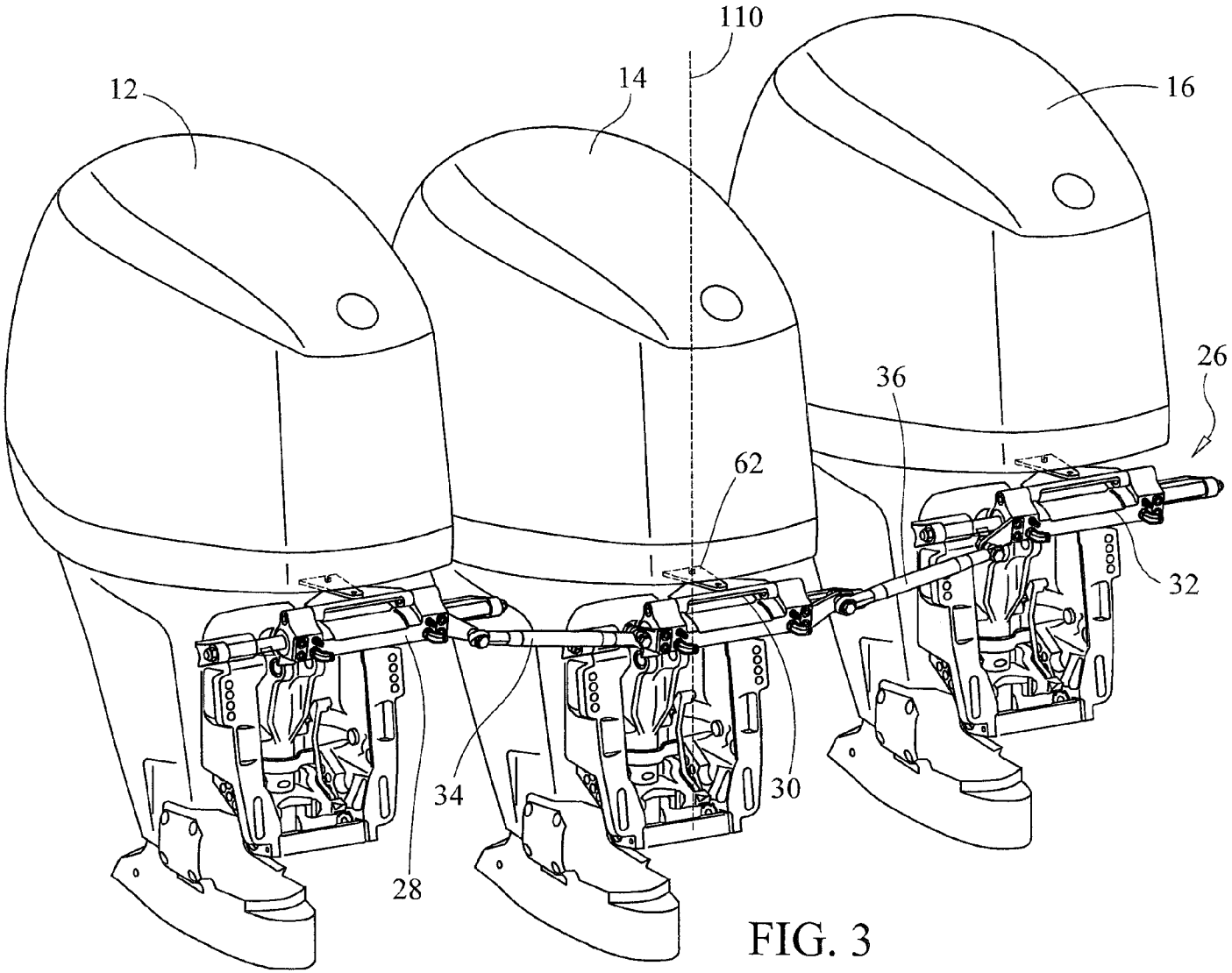
FIG. 3 is another perspective view of the improved steering system and propulsion units.
Figure 4:
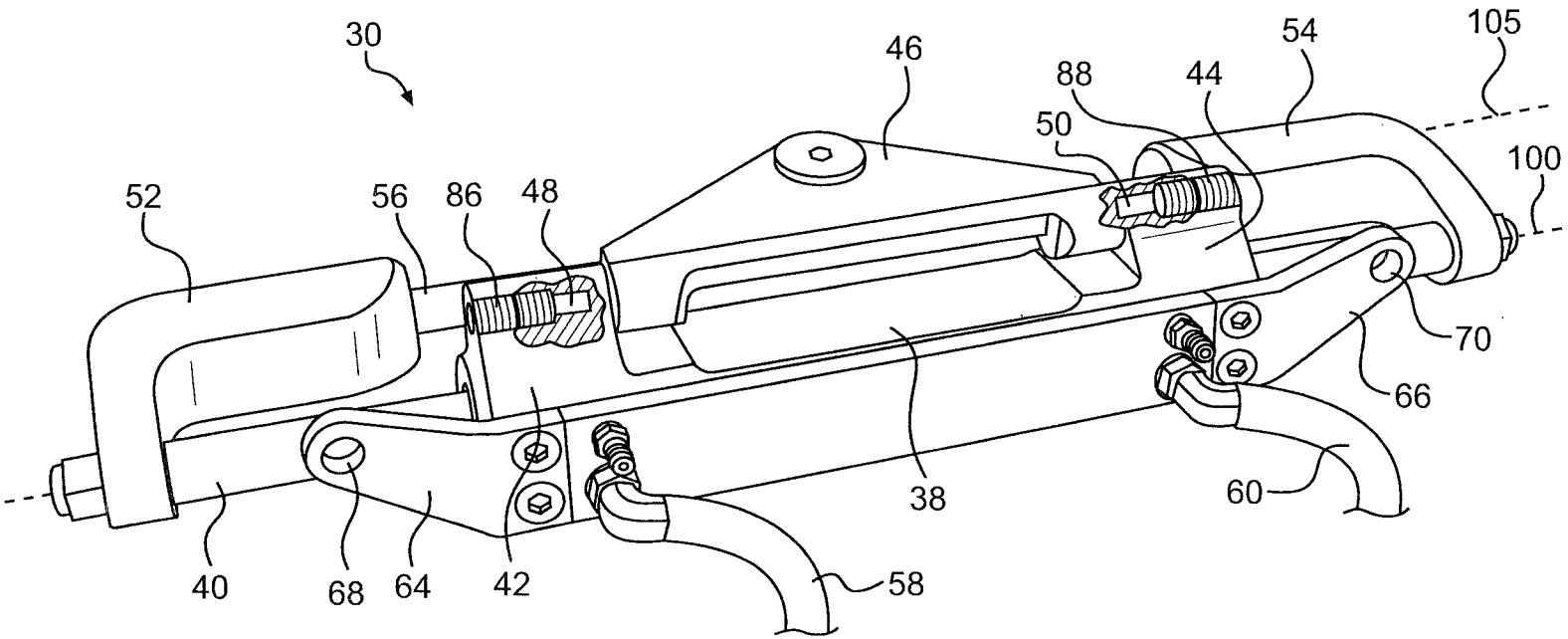
FIG. 4 is a perspective, partially broken away, view of a middle hydraulic steering actuator of the improved steering system.
Figure 4A:
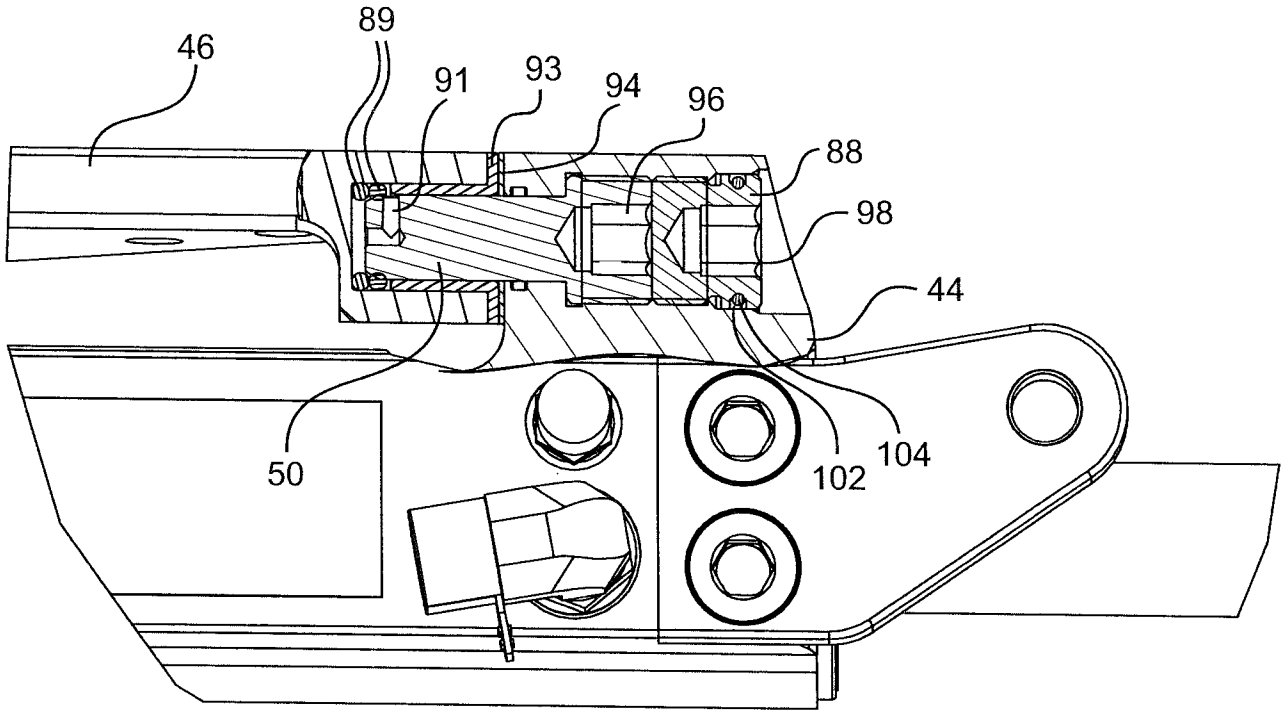
FIG. 4*a* is a partial cut away front view of the right side of a steering actuator similar to that shown in FIG. 4.

FIGS. 4 and 4*a* show the middle steering actuator 30 in greater detail. The middle steering actuator 30 includes a hydraulic cylinder 38 with a piston rod 40 reciprocatingly mounted therein allowing for relative movement of the cylinder 38 along a piston rod axis 100. The cylinder 38 has a pair of spaced-apart cylinder arms 42 and 44 which extend radially outward of the cylinder 38. A pivot plate 46 is pivotably connected to each of the cylinder aims 42 and 44 by pivot pins 48 and 50. The pivot plate 46 extends between the cylinder arms 42 and 44 and the cylinder arms may pivot about the pivot plate 46. Support arms 52 and 54 connect opposite ends of the piston rod 40 to a tilt rod 56 of a tilt tube (not shown) of the middle engine 14 which is shown in FIGS. 1 to 3. The support arms 52 and 54 restrict axial movement of the piston rod 40 relative to the marine vessel 10. The support arms 52 and 54 also allow arcuate movement of the cylinder 38 and piston rod 40, about a tilt axis 105, while maintaining the piston rod axis 100 parallel to the tilt axis 105.

Hydraulic conduits 58 and 60 hydraulically connect opposite ends of the cylinder 38 to the helm pump (not shown). Hydraulic fluid pumped from the helm pump actuates the cylinder 38 to reciprocate linearly relative to the piston rod 40. One of ordinary skill in the art after reviewing this disclosure will understand how the hydraulic fluid is pumped from the helm pump. In particular, the piston rod 40 remains axially stationary relative to the marine vessel 10, shown in FIG. 1, while the cylinder 38 reciprocates relative to the marine vessel 10.

Referring to FIG. 2, a steering member in the form of tiller 62 of the middle engine 14 is pivotably connected to the pivot plate 46 of the middle steering actuator 30. The relative linear movement of the cylinder 38 is thus transmitted to the tiller 62. This causes the tiller 62 to pivot about a steering axis 110 and the middle engine 14 to be steered. The starboard and port engines 12 and 16 are steered in a similar manner by the starboard and port side steering actuators 28 and 32. Furthermore, movement by any one of the steering actuators is transmitted by the tie bars 34 and 36 to the other ones of the steering actuators, allowing the engines to be steered simultaneously. As thus far described the steering assembly 26 and steering actuators 28, 30 and 32 are conventional.

However, as shown in FIG. 4 and FIG. 4*a*, which is a partial cut away view similar to what is shown in FIG. 4, the middle steering actuator 30 is provided with asymmetrical tie bar mounts 64 and 66. The tie bar mounts 64 and 66 are each provided with an aperture 68 and 70, respectively. The apertures 68 and 70 extend axially in a direction generally perpendicular to the piston rod axis 100. The tie bar mounts 64 and 66 are substantially identical and one of the tie bar mounts 66 is shown in greater detail in FIGS. 5 and 5*a*. The tie bar mount 66 includes a first portion 72 and a second portion 74 which extends angularly from the first portion in an upwardly direction relative to the piston rod axis 100. In this example, the first portion 72 of the tie bar mount 66 has generally quadrilateral shape and the second portion 74 of the tie bar mount 66 has generally symmetrical, curved shape. Line 115 represents the divide between the first portion 72 of the tie bar mount 66 and the second portion 74 of the tie bar mount 66.

Figure 5:
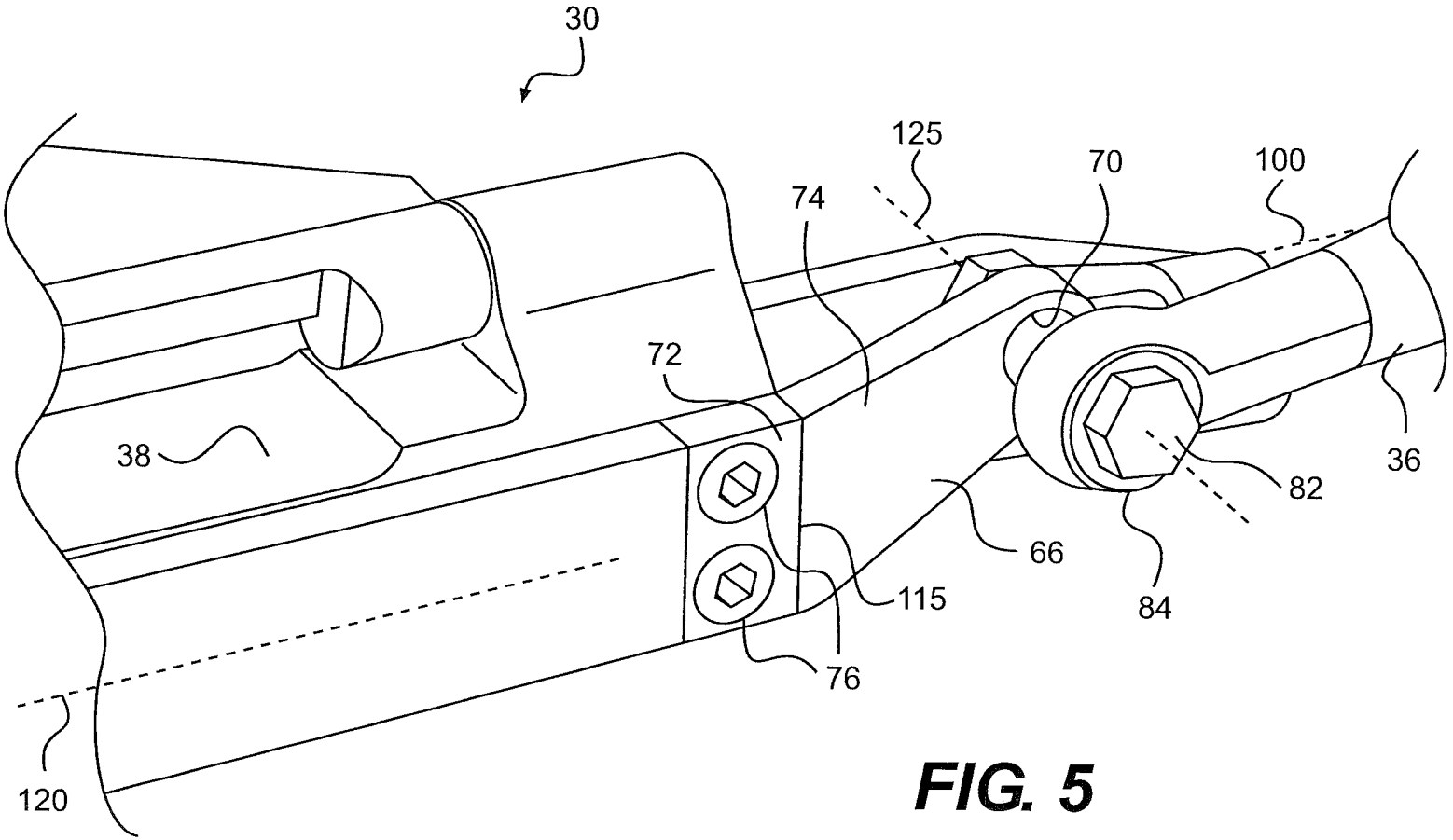
FIG. 5 is a view of the middle actuator of the improved steering system.
Figure 5A:
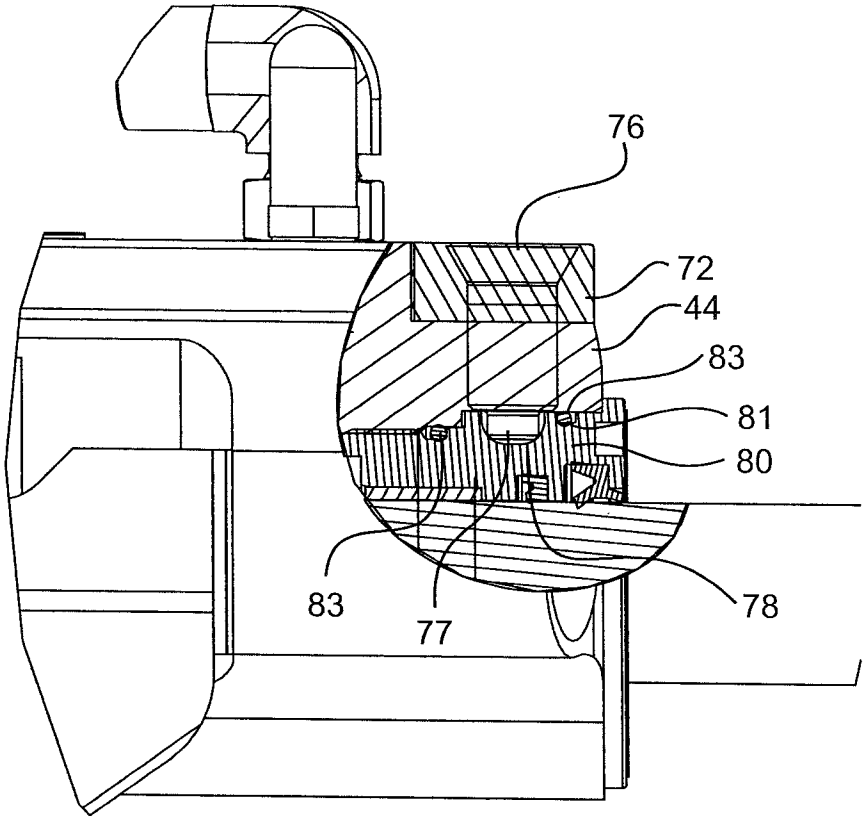
FIG. 5*a* is a partial broken away top view of the middle actuator of FIG. 5.

As shown in FIGS. 5 and 5*a*, connecting members in the form of bolts 76 secure the tie bar mount 66 to the cylinder 38 of the middle steering actuator 30. The bolts 76 extend in a direction generally perpendicular to the piston rod axis 100. A projection 77 on the bolt 76 may engage a groove 78 in an end gland 80 of the cylinder 38. The end gland 80 may have grooves 81 to accommodate O-rings 83. The bolt 76 maintains the gland 80 in position and prevents the gland 80 from becoming decoupled from the cylinder 38 in response to frictional and vibratory forces during operation of the hydraulic steering system. Preferably, only a bolt 76 near a center line 120 of the cylinder 38 engages the grove 78 in the end gland 80. The center line 120 is typically coaxial with the piston rod axis 100 and the cylinder 38 is provided with grooved end glands at both ends thereof.

A connecting member in the form of bolt 82 extends through the aperture 70 in the tie bar mount 66 and a ball joint 84 in the tie bar 36. The bolt 82 connects the tie bar mount 66 to the tie bar 36, allowing the middle steering actuator 30 to be connected to the port side actuator 32 as shown in FIG. 2. The bolt 82 extends in a direction generally perpendicular to the piston rod axis 100 and allows the tie bar 36 to be connected to the tie bar mount 66 on a vertical plane so as to permit pivoting of the tie bar 36 about a generally horizontal axis 125 along the bolt 82. The ball joint 84 provides an articulate connection between the tie bar mount 66 and the tie bar 36. Other embodiments may use other articulating joints as the features described herein are not limited to ball joints only. The articulate connection allows the tie bar 36 to reciprocate along its longitudinal axis when the engines 12, 14 and 16 are moved back and forth as the marine vessel is steered. The middle steering actuator 30 is connected to the starboard side actuator 28 in a similar manner by tie bar mount 64 and tie bar 34.

As shown in FIGS. 4, and 4*a* the middle steering actuator 30 is further provided with a pair set screws 86 and 88 which exert a compression force against the pivot pins 48 and 50, respectively. The set screws 86 and 88 provide a redundancy to maintain the pivot pins 48 and 50 in position. In other embodiments set screws may be used to provide a redundancy to maintain other pins or screws in position. For example, set screws may be used to provide a redundancy to maintain the bolts which secure the tie bar mounts to the cylinder in position.

FIG. 4*a* shows a right side of a middle hydraulic steering actuator of an improved steering system similar to that shown in FIG. 4. The tie bar mount 66 shown in FIG. 4*a* is slightly different than that shown in FIG. 4. One of ordinary skill in the art will understand that modifications to the system shown in the Figures may be done in accordance with the invention. As shown in FIG. 4*a*, O-rings 89 may be located near the pivot pin 50. The pivot pin 50 may have a passageway 91 in order to provide an escape pathway for grease, air and/or other materials. The pivot pin 50 may be fit in a flange bushing 93. In some embodiments the flange bushing 93 may be plastic although it is not limited to plastic. The flange bushing 93 may butt against a washer 94. The washer 94 may be stainless steel but is not limited to that material.

Both the pivot pin 50 and the set screw 88 may have structure 96, 98 to allow a tool to engage the pivot pin 50 and set screw 88 to turn them. In some embodiments the structure may be a hex broach 96,98 as shown in FIG. 4*a* but it is not limited to hex broaches. The set screw 88 may have a groove 102 to accommodate an O-ring 104.

Figure 6:
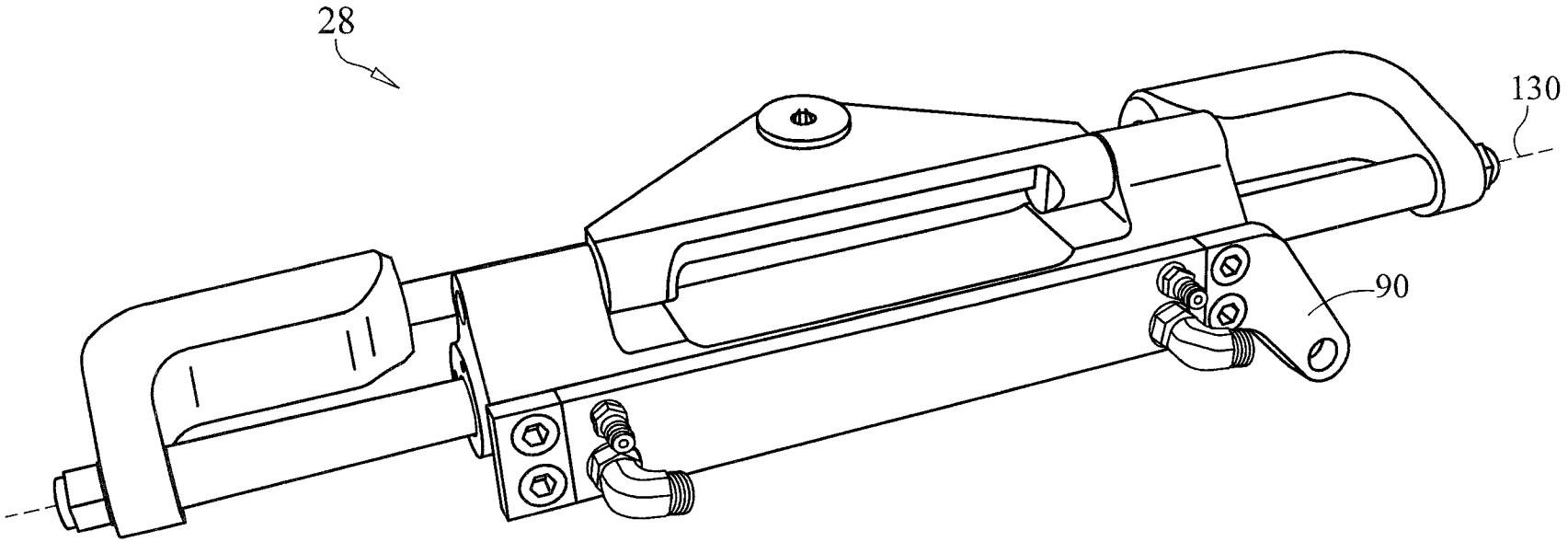
FIG. 6 is a perspective view of a starboard side hydraulic steering actuator of the improved steering system.
Figure 7:
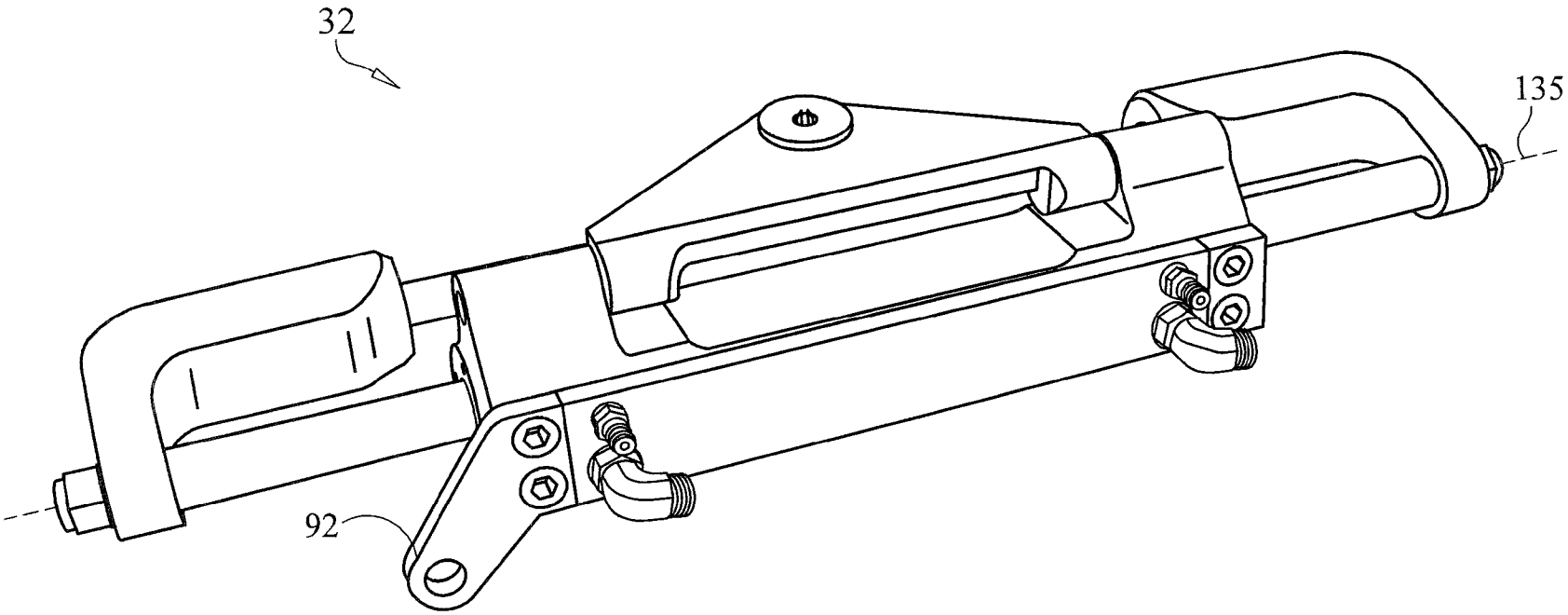
FIG. 7 is a perspective view of a port side hydraulic steering actuator of the improved steering system.

The starboard and port side steering actuators 28 and 32, best shown in FIGS. 6 and 7, are substantially similar in structure and function in a substantially similar manner as the middle steering actuator 30. However, the starboard side steering actuator 28 is provided with only one tie bar mount 90 which extends in a downwardly direction relative to its piston rod axis 130. Likewise the port side steering actuator 32 is provided with only one tie bar mount 92 which extends in a downwardly direction relative to its piston rod axis 135. The starboard side actuator 28 and port side actuators 32 are mirror images and are coupled to opposite sides of the middle actuator 30 by corresponding tie bars 34 and 36, as shown in FIGS. 2 and 3. There is an articulate connection between each of the tie bar mounts and the tie bars to allow the tie bars to rotate about their points of connection with the tie bar mounts when the engines 12, 14 and 16 are moved back and forth and/or tilted as the marine vessel 10 is steered.

As best shown in FIG. 2, providing the steering assembly 26 with upwardly and downwardly extending tie bar mounts 64, 66, 90 and 92 allows for improved mechanical coupling of the vertically offset engines 28, 30 and 32. In particular, the slope of tie bars 34 and 36 relative to the horizontal, as represented by angles $\alpha_1$ and $\alpha_2$, is reduced and in some embodiments the tie bars may be completely horizontal. In the embodiment of the steering assembly 26 disclosed herein the engines 28, 30 and 32 are vertically offset because the middle engine 30 is mounted in the recessed portion 24 of the transom 22. However, the steering assembly may also be used in situations where a vertical offset results because different types of engines are coupled, for example in a steering system including a primary propulsion unit and an auxiliary propulsion unit. The steering assembly may also be used in situations where there is no vertical offset. When there is no vertical offset the tie bar mounts may all extend in the same direction.

Figure 8:
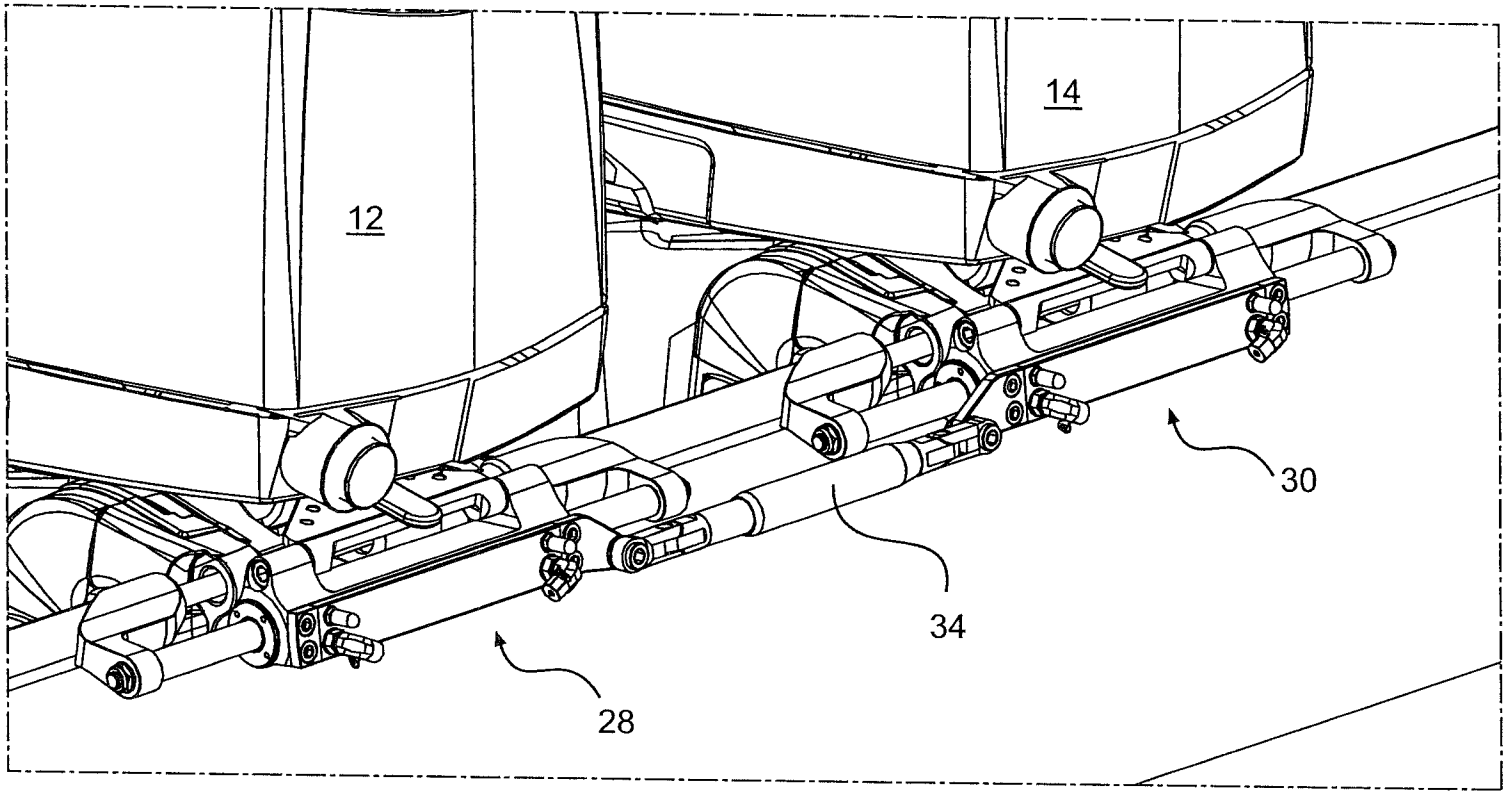
FIG. 8 is a partial perspective view of an improved steering system used with two propulsion units.
Figure 9:
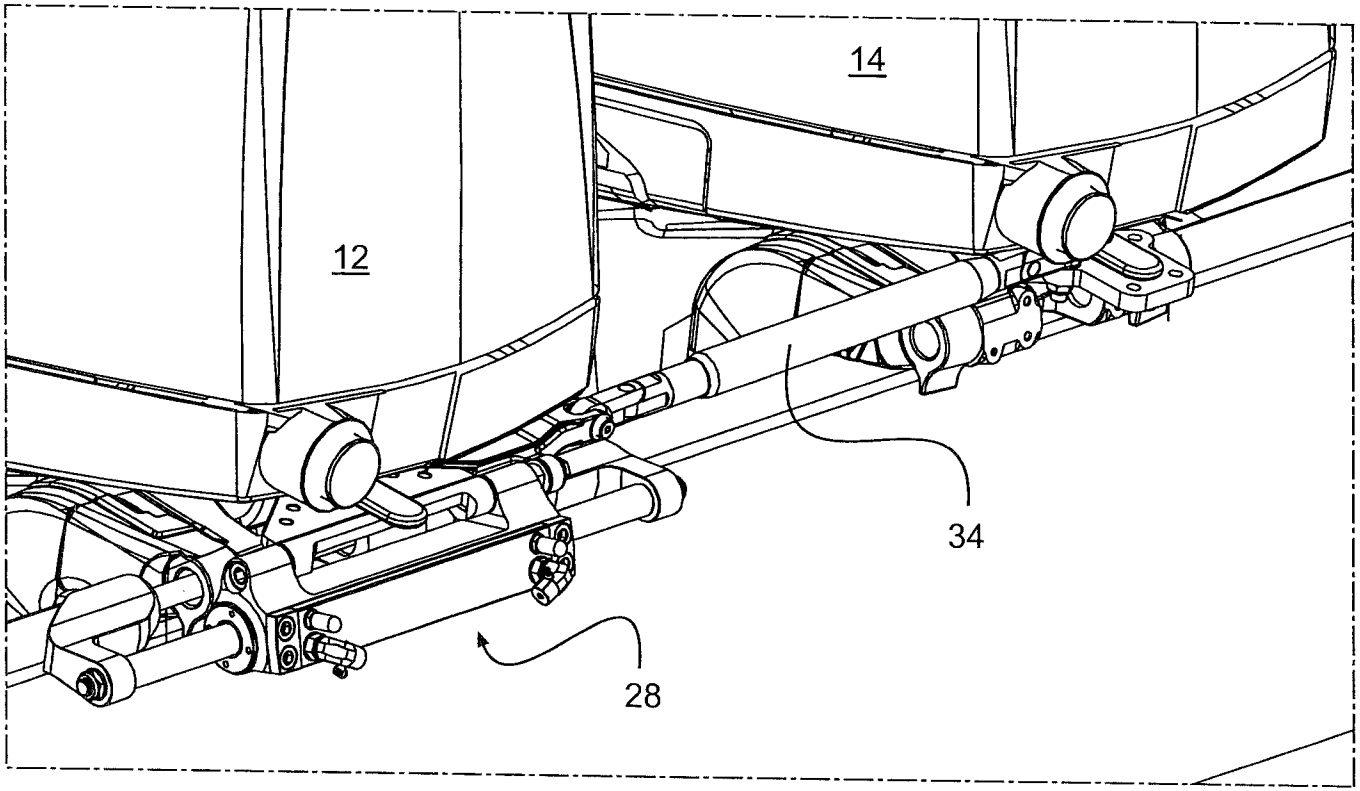
FIG. 9 is a partial perspective view of an alternate improved steering system used with two propulsion units.
Figure 10:
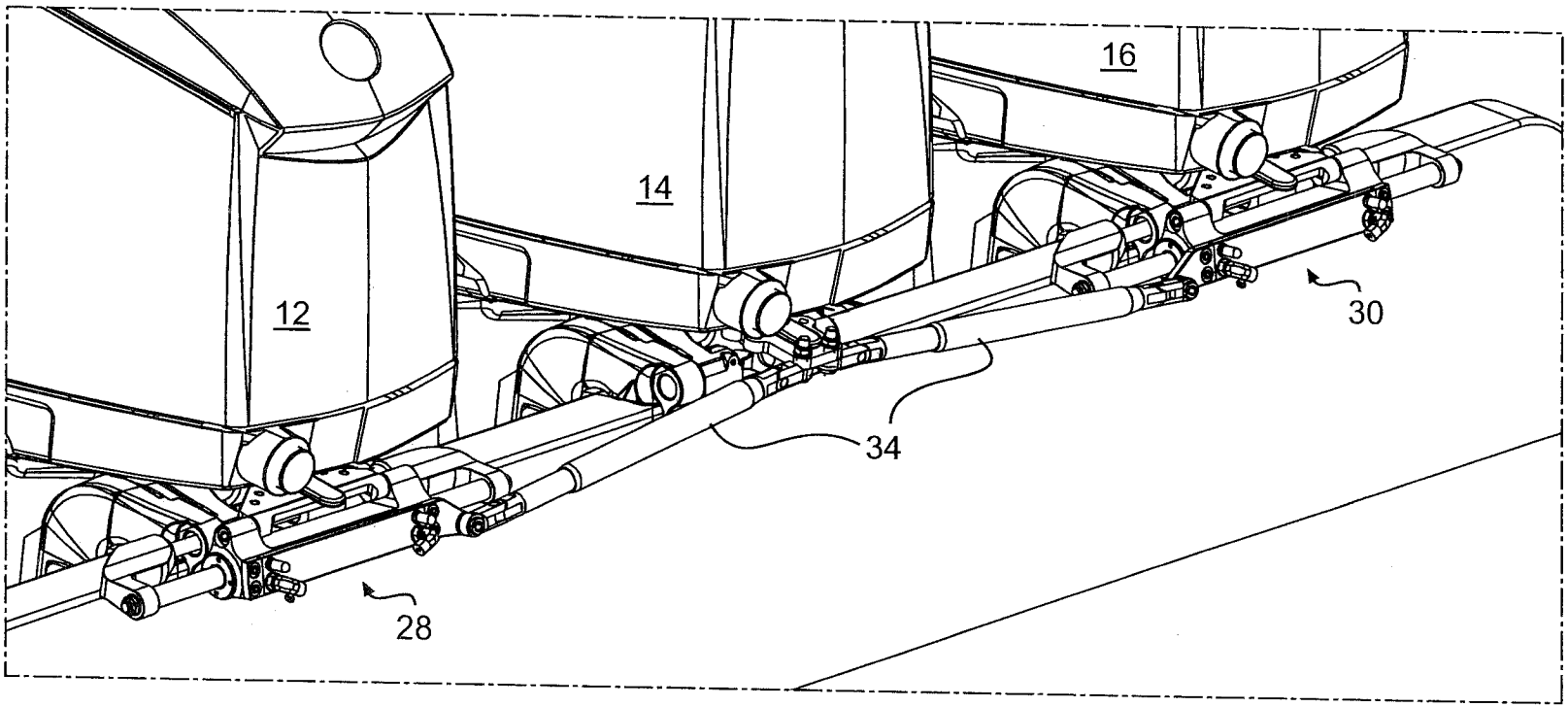
FIG. 10 is a partial perspective view of an alternate improved steering system used with three propulsion units.

FIGS. 8-10 show that various embodiments of the invention may be used with a number of different engine configurations and component configurations. For example, FIG. 8 is a partial perspective view of an improved steering system used with two propulsion units. FIG. 9 is a partial perspective view of an alternate improved steering system used with two propulsion units. FIG. 10 is a partial perspective view of an alternate improved steering system used with three propulsion units. The various Figures shown herein show alternate configurations of tie bars 34 and steering actuators 28, 30, 32. Various embodiments in accordance with the invention may use the configurations of tie bars 34 and steering actuators 28, 30, 32 shown or other variations. Additional numbers of propulsion units other than the three shown and the specific configurations shown may also be used in some embodiments of the invention.

It will be understood by a person skill in the art that the terms "upwardly", and "downwardly" as used herein are used with reference to the upwardly and downwardly directions when the steering assembly is in use.

It will further be understood by a person skilled in the art that many of the details provided above are by way of example only, and are not intended to limit the scope of the invention which is to be determined with reference to follow claims.

What is claimed is:

1. A hydraulic steering actuator comprising:

a cylinder and piston rod reciprocatingly mounted within the cylinder and extending through the cylinder for movement along a piston rod axis;

a pair of spaced-apart cylinder arms extending radially outward of the cylinder and a pivot plate extending between the cylinder arms;

a pair of support arms which are pivotable about a tilt axis and are connected to opposite ends of the piston rod to allow arcuate movement of the piston rod about the tilt axis while maintaining the piston rod axis parallel to the tilt rod axis; and a tie bar mount connected to the cylinder by a first connecting member, the tie bar mount having an aperture extending therethrough, wherein the aperture extends axially in a direction substantially perpendicular to the piston rod axis and a tie bar is connected to the tie bar mount by a second connecting member that extends through the aperture.

2. The hydraulic steering actuator as claimed in claim 1 wherein the first connecting member extends in a direction substantially perpendicular to the tilt axis.

3. The hydraulic steering actuator as claimed in claim 2 further including a gland disposed at an end of the cylinder, wherein the gland has a groove which receives the first connecting member.

4. The hydraulic steering actuator as claimed in claim 3 wherein the first connecting member engages the groove near a center line of the cylinder.

5. The hydraulic steering actuator as claimed in claim 1 further including pivot pins which connect the pivot plate to the cylinder arms and set screws which exert a compression force against the pivot pins.

6. The hydraulic steering actuator as claimed in claim 1 wherein the tie bar mount is asymmetrical.

7. The hydraulic steering actuator as claimed in claim 1 wherein the tie bar mount extends in an upwardly direction relative to the piston rod axis.

8. The hydraulic steering actuator as claimed in claim 1 wherein the tie bar mount extends in a downwardly direction relative to the piston rod axis.

9. The hydraulic steering actuator as claimed in claim 1 wherein the tie bar mount extends angularly from the piston rod axis.

10. The hydraulic steering assembly as claimed 1 wherein the tie bar mount of the first hydraulic steering actuator extends angularly from the piston rod axis thereof.

11. A hydraulic steering assembly for applying a force to tillers of at least two marine propulsion units, the hydraulic steering assembly comprising:

a first hydraulic steering actuator operatively coupled to a tiller of a first propulsion unit, the first hydraulic steering actuator including:

a cylinder and piston rod reciprocatingly mounted within the cylinder and extending through the cylinder for movement along a piston rod axis;

a pair of spaced-apart cylinder arms extending radially outward of the cylinder and pivot plate extending between the cylinder arms;

a pair of support arms which are pivotable about a tilt axis and are connected to opposite ends of the piston rod to allow arcuate movement of the piston rod about the tilt axis while maintaining the piston rod axis parallel to the tilt rod axis; and a tie bar mount disposed on the cylinder and having an aperture extending in an axial direction substantially perpendicular to the piston rod axis thereof;

a second hydraulic steering actuator operatively coupled to a tiller of a second propulsion unit, the second hydraulic steering actuator including:

a cylinder and piston rod reciprocatingly mounted within the cylinder and extending through the cylinder for movement along a piston rod axis;

a pair of spaced-apart cylinder arms extending radially outward of the cylinder and a pivot plate extending between the cylinder arms;

a pair of support arms which are pivotable about a tilt axis and are connected to opposite ends of the piston rod to allow arcuate movement of the piston rod about the tilt axis while maintaining the piston rod axis parallel to the tilt rod axis; and a tie bar mount disposed on the cylinder and having an aperture extending axially in a direction substantially perpendicular to the piston rod axis thereof; and a tie bar coupling the tie bar mount of the first hydraulic actuator to the tie bar mount of the second hydraulic actuator, wherein, a first connecting member which connects the tie bar to the tie bar mount of the first hydraulic actuator extends in a direction substantially perpendicular to the tilt axis of the first hydraulic actuator and a second connecting member which connects the tie bar to the tie bar mount of the second hydraulic actuator extending in a direction substantially perpendicular to the tilt axis of the second hydraulic actuator.

12. The hydraulic steering assembly as claimed 11 wherein the tie bar mount of the first hydraulic steering actuator extends in a downwardly direction relative to the piston rod axis thereof.

13. The hydraulic steering assembly as claimed 11 wherein the tie bar mount of the second hydraulic steering actuator extends in an upwardly direction relative to the piston rod axis thereof.

14. The hydraulic steering assembly as claimed 11 wherein the first steering actuator and second steering actuator are mirror images.

15. The hydraulic steering assembly as claimed 11 wherein the tie bar mount of the second hydraulic steering actuator angularly from the piston rod axis thereof.

* * * * *

UNITED STATES PATENT AND TRADEMARK OFFICE

CERTIFICATE OF CORRECTION

PATENT NO. : 8,430,702 B2
APPLICATION NO. : 13/071874
DATED : April 30, 2013
INVENTOR(S) : Noam Davidson et al.

It is certified that error appears in the above-identified patent and that said Letters Patent is hereby corrected as shown below:

In the Claims:

Col. 8, lines 30-32 should read

15. The hydraulic steering assembly as claimed 11 wherein the tie bar mount of the second hydraulic steering actuator extends angularly from the piston rod axis thereof.

Signed and Sealed this
Thirteenth Day of August, 2013

Teresa Stanek Rea
*Acting Director of the United States Patent and Trademark Office*